US009548556B2

(12) United States Patent
Uchida

(10) Patent No.: US 9,548,556 B2
(45) Date of Patent: Jan. 17, 2017

(54) CONNECTOR

(71) Applicant: Sumitomo Wiring Systems, Ltd., Yokkaichi, Mie (JP)

(72) Inventor: Masashi Uchida, Mie (JP)

(73) Assignee: SUMITOMO WIRING SYSTEMS, LTD, Yokkaichi (JP)

( * ) Notice: Subject to any disclaimer, the term of this patent is extended or adjusted under 35 U.S.C. 154(b) by 0 days.

(21) Appl. No.: 15/063,581

(22) Filed: Mar. 8, 2016

(65) Prior Publication Data

US 2016/0294097 A1 Oct. 6, 2016

(30) Foreign Application Priority Data

Apr. 3, 2015 (JP) ..... 2015-076897

(51) Int. Cl.
*H01R 9/05* (2006.01)
*H01R 13/436* (2006.01)
*H01R 13/52* (2006.01)

(52) U.S. Cl.
CPC ..... *H01R 13/4367* (2013.01); *H01R 13/5205* (2013.01)

(58) Field of Classification Search
CPC ..... H01R 17/12; H01R 13/4223; H01R 4/185
USPC ..... 439/578, 595, 752.5, 585, 610, 877
See application file for complete search history.

(56) References Cited

U.S. PATENT DOCUMENTS 6,641,437 B2 * 11/2003 Tsuji ..... H01R 13/4223 439/595
6,672,910 B2 * 1/2004 Hotea ..... H01R 13/18 439/843
7,695,289 B1 * 4/2010 Sato ..... H01R 12/57 439/78
2011/0028033 A1 * 2/2011 Sato ..... H01R 24/50 439/578

FOREIGN PATENT DOCUMENTS

JP 5044508 7/2012
JP 2012-227090 11/2012
JP 2014-75298 4/2014

* cited by examiner

*Primary Examiner* — Phuongchi T Nguyen
(74) *Attorney, Agent, or Firm* — Gerald E. Hespos; Michael J. Porco; Matthew T. Hespos

(57) ABSTRACT

A connector (C) has a terminal fitting (10) including a terminal connecting portion (11) to be connected to a mating terminal and barrels to be crimped to a wire (W). A housing (50) has a terminal accommodating chamber (57) that is configured to accommodate the terminal fitting (10). A sleeve (20) has an accommodation space (21) configured to accommodate the barrels crimped to the wire (W). A rubber plug (45) includes a center hole (46) and is configured so that the wire (W) extending back from a rear wall (24B) of the accommodation space (21) penetrates therethrough in a sealed state. A rear holder (60) obstructs rearward movement of the terminal fitting (10) via the sleeve (20). A center position (P2) of the center hole (46) is displaced toward a rear bottom plate (19B) from a center position (P1) of the terminal connecting portion (11).

3 Claims, 12 Drawing Sheets

CONNECTOR

BACKGROUND

1. Field of the Invention

The invention relates to a connector.

2. Description of the Related Art

Japanese Patent No. 5044508 discloses a connector for retaining a terminal fitting by a sleeve. This terminal fitting includes an electrical contact portion to be connected electrically to a terminal fitting of a mating connector, a hollow cylindrical wire connecting portion to be connected to a core of a wire and a flange on an end part of the wire connecting portion near the electrical contact portion. The sleeve contacts the flange from behind and a rear holder contacts the sleeve from behind. The terminal fitting is retained in a connector housing by fixing the rear holder to the connector housing.

The above-described electrical contact portion is of a type called a closed barrel and diameters of usable wires are limited sufficiently so that many types of wires cannot be used. Open barrels can be used to accommodate wires ranging from thin wires to thick wires. A charging terminal with an open barrel is described in Japanese Unexamined Patent Publication No. 2014-75298 and a terminal fitting with an open barrel is described in Japanese Unexamined Patent Publication No. 2012-227090.

A wire is crimp-connected to an open barrel by crimping each barrel piece toward a bottom plate without changing the position of the bottom plate. Thus, a center position of the wire after crimping varies depending on a wire diameter, and a center position of a thin wire after crimping is located lower than that of a thick wire. Further, the amount of compressing of a thin wire against an inner peripheral sealing surface of a rubber plug mounted behind a terminal fitting is originally small. Thus, if a center position of the wire is displaced down from a center position of the rubber plug, the amount of squeezing becomes smaller on an upper part of the inner peripheral sealing surface of the rubber plug, thereby reducing sealing performance.

SUMMARY

A connector in accordance with the invention has a terminal. The terminal has a terminal connecting portion to be connected to a mating terminal and a bottom plate extending back from the terminal connecting portion. Two barrels stand up from the bottom plate and are crimped to a wire by being pushed toward the bottom plate across the wire arranged between the bottom plate and the barrels. The connector also has a housing with a terminal accommodating chamber configured to accommodate the terminal. The connector further has a sleeve with an accommodation space configured to accommodate the barrels crimped to the wire. An insertion groove is provided in a rear wall of the accommodation space so that the wire extending back from the barrels penetrates therethrough. Press-fit projections project back from the rear wall of the accommodation space. A rubber plug includes press-fit holes configured so that the press-fit projections are press-fit into the press-fit holes to mount the rubber plug on the rear wall of the accommodation space. The rubber plug also has a wire sealing hole configured so that the wire extending back from the rear wall of the accommodation space penetrates therethrough in a sealed state. A holder is mounted on the housing while being held in contact with the press-fit projections from behind. Thus, the holder obstructs a backward movement of the terminal via the sleeve. A center position of the wire sealing hole is displaced toward the bottom plate from a center position of the terminal connecting portion.

According to this configuration, the center position of the wire is displaced more toward the bottom plate from the center position of the terminal connecting portion by crimping the barrels to the wire particularly in the case of a thin wire than in the case of a thick wire. However, the center position of the wire sealing hole is displaced toward the bottom plate from the center position of the terminal connecting portion so that the wire can be pulled directly out backward. Thus, the amount of squeezing of an inner peripheral sealing surface of the wire sealing hole can be made substantially equal over the entire circumference and a reduction of sealing performance is avoided.

On the other hand, in the case of a thick wire, the center position of the wire is displaced toward a side opposite to the bottom plate from the center position of the wire sealing hole by crimping the pair of barrels to the wire. However, the amount of squeezing of the inner peripheral sealing surface of the wire sealing hole is originally larger than in the case of a thin wire and the inner peripheral sealing surface of the wire sealing hole can be held in close contact with the outer peripheral surface of the wire over the entire circumference. Thus, sealing performance is not reduced. Accordingly, sealing performance can be ensured for both thin wires and thick wires and a range of applicable wires can be expanded.

The terminal connecting portion may have a hollow cylindrical main body extending in a front-back direction, and a lock may be behind the main body on the terminal. The sleeve may include a fitting protrusion configured to support the main body by being fit into the main body and a locked portion configured to obstruct a backward movement of the terminal by being locked to the locking portion from behind when the fitting protrusion is fit into the main body. Accordingly, a backward movement of the terminal can be obstructed by fitting the fitting protrusion into the main body to support the main body and locking the locked portion to the locking portion from behind.

The wire may have a core is covered by an insulation coating. The barrel may include a wire barrel to be crimped to the core and an insulation barrel to be crimped to the insulation coating. According to this configuration, a holding force for the wire can be ensured by the wire barrels and the center position of the wire can be set appropriately by the insulation barrels.

According to the technology disclosed by this specification, it is possible to ensure sealing performance for both thin wires and thick wires and expand a range of applicable wires.

DETAILED DESCRIPTION

An embodiment of the invention is described on the basis of FIGS. 1 to 12. In this embodiment, a charging connector is mounted on the tip of a gun-shaped case (not shown) and is connected to a vehicle-side connector provided in a vehicle.

Figure 8:
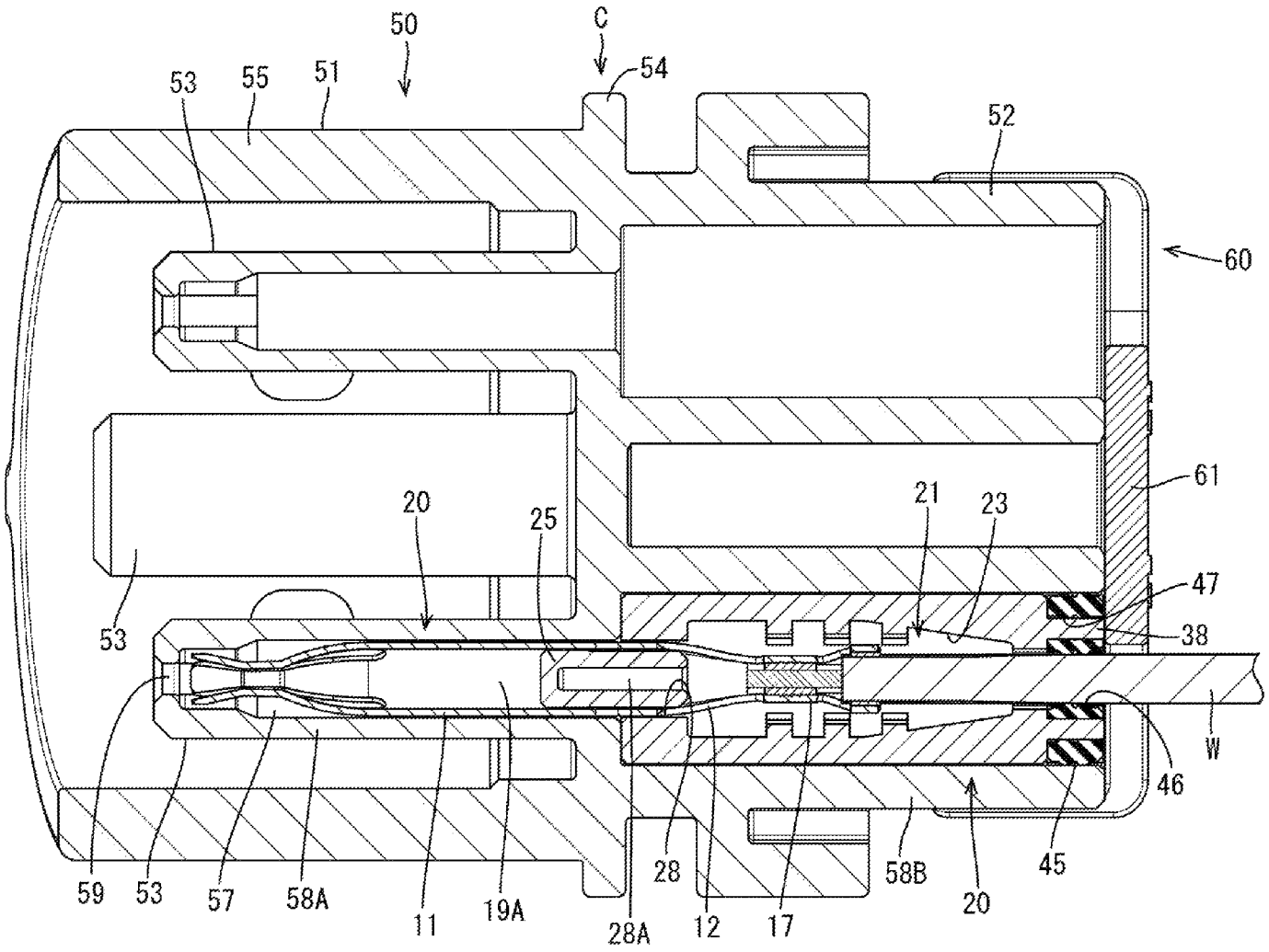
FIG. 8 is a section along VIII-VIII of FIG. 7.

The charging connector C is a five-pole connector and includes terminal fittings 10 connected to ends of wires W and a housing 50 for accommodating the terminal fittings 10, as shown in FIG. 8.

The terminal fittings 10 include two power terminals, one ground terminal and two signal terminals and basic structures thereof are similar although diameters and the like may differ depending on the type. The following description of the signal terminal is given as an example.

Figure 9:
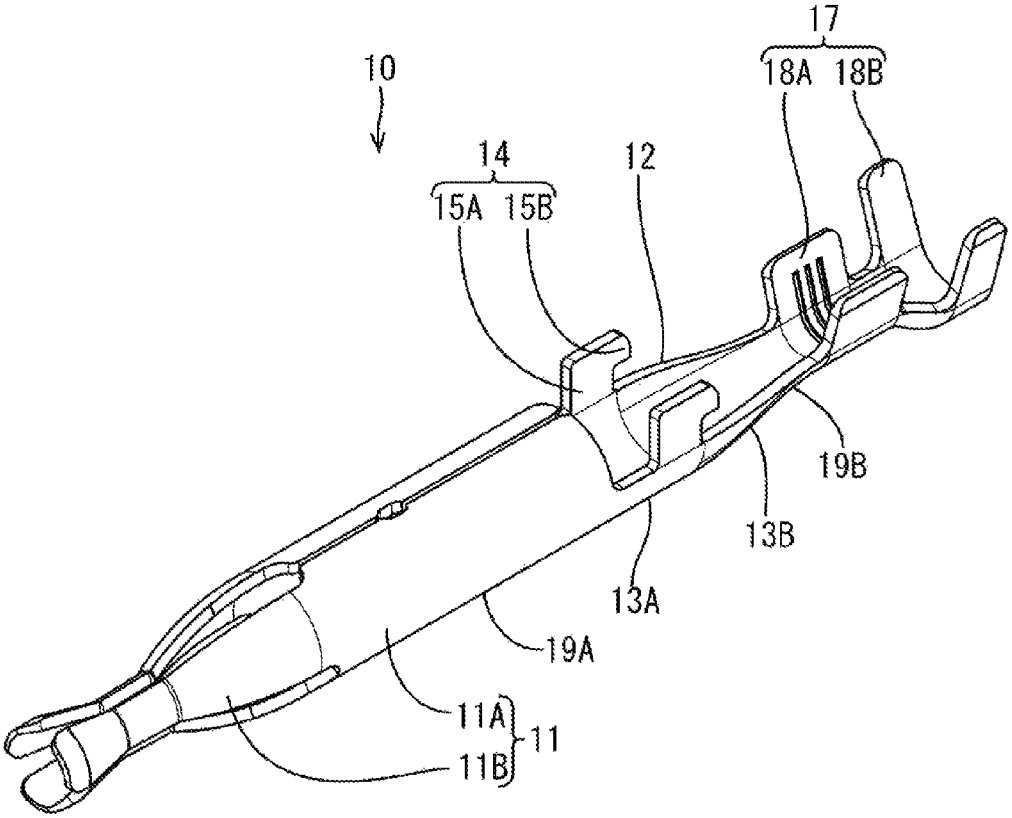
FIG. 9 is a perspective view of the terminal fitting
Figure 10:
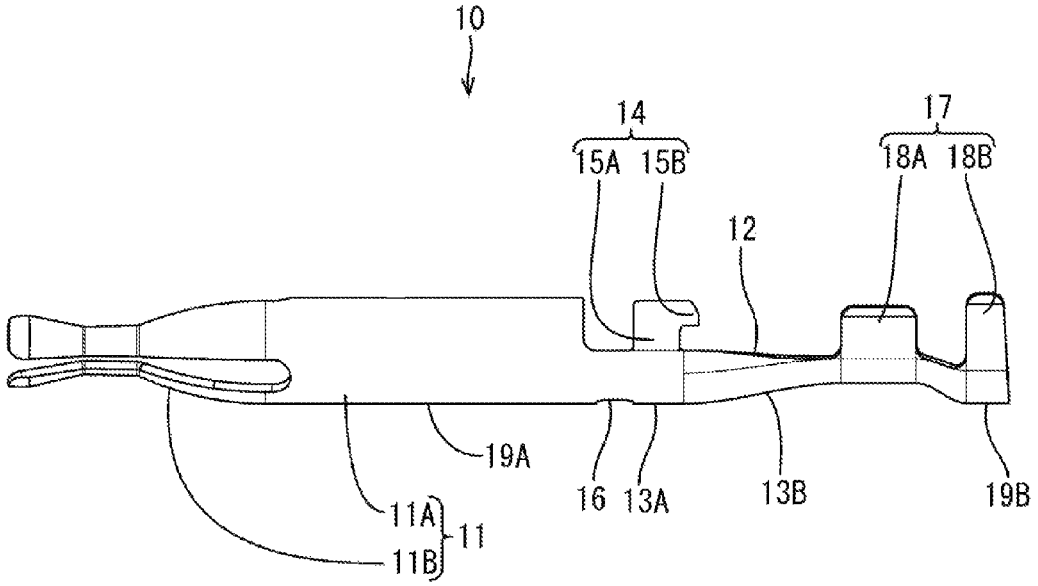
FIG. 10 is a side view of the terminal fitting

The terminal fitting 10 is a female terminal and formed into a shape as shown in FIGS. 9 and 10 by press-forming a metal plate with excellent electrical conductivity.

The terminal fitting 10 has a terminal connecting portion 11, a coupling 12 and a wire connecting portion 17 connected successively from the front. The wire connecting portion 17 is to be crimped to the end of the wire W. The terminal connecting portion 11 is to be connected to a mating vehicle-side male terminal and is provided with a front bottom plate 19A. The coupling portion 12 and the wire connecting portion 17 are provided with a rear bottom plate 19B that extends back from the front bottom plate 19A of the terminal connecting portion 11.

The terminal connecting portion 11 is bent and curved to define a hollow cylindrical main body 11A extending in a front-back direction and a plurality of resilient pieces 11B extending forward from the front edge of the main body 11A. The resilient pieces 11B are resiliently expandable and contractible in diameter.

The wire connecting portion 17 is formed so that open wire barrels 18A and open insulation barrels 18B are provided side by side in a front-back direction. The wire barrels 18A and the insulation barrels 18B stand up from the rear bottom plate 19B. The wire barrels 18A are crimped to the wire W by being pressed and caulked toward the rear bottom plate 19B across a core Wa of the wire W arranged between the wire barrels 18A and the rear bottom plate 19B.

The coupling 12 couples the main body 11A of the terminal connecting portion 11 and the wire connecting portion 17 and has a U-shaped cross-section that opens up. A substantially half length area on a front side of the coupling 12 is an equal-width portion 13A having a width equal to a diameter of the terminal connecting portion 11 and a remaining rear area is a tapered portion 13B whose width is gradually narrowed toward the back.

Two inclination regulating pieces 14 are formed parallel to each other on the upper edges of opposite left and right walls of the equal-width portion 13A. The inclination regulating piece 14 is formed into a hook shape so that a sandwiched portion 15B projects back on the upper end of a standing portion 15A.

Figure 5:
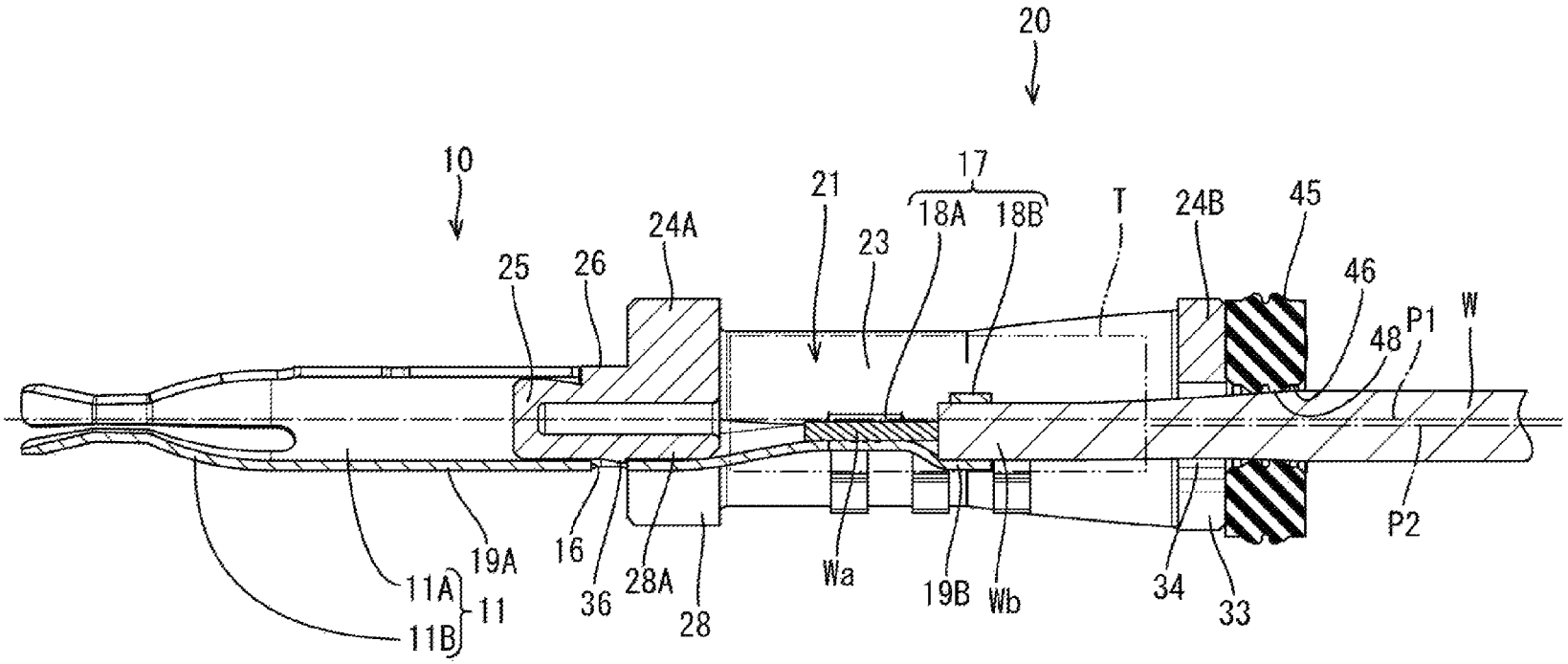
FIG. 5 is a section along V-V of FIG. 3.

The end of the wire W is connected to the wire connecting portion 17 of the terminal fitting 10 structured as described above. Specifically, as shown in FIG. 5, the wire W is stripped to remove an insulation coating Wb along a predetermined length and an exposed end of the core Wa projects from the remaining end of the insulation coating Wb. The wire barrels 18A of the terminal fitting 10 are crimped to the exposed end of the core Wa, and the insulation barrels 18B are crimped to the end of the insulation coating Wb. A part of the end of this wire W connected to the wire connecting portion 17 by crimping is sealed, utilizing a heat shrinkable tube T.

Figure 7:
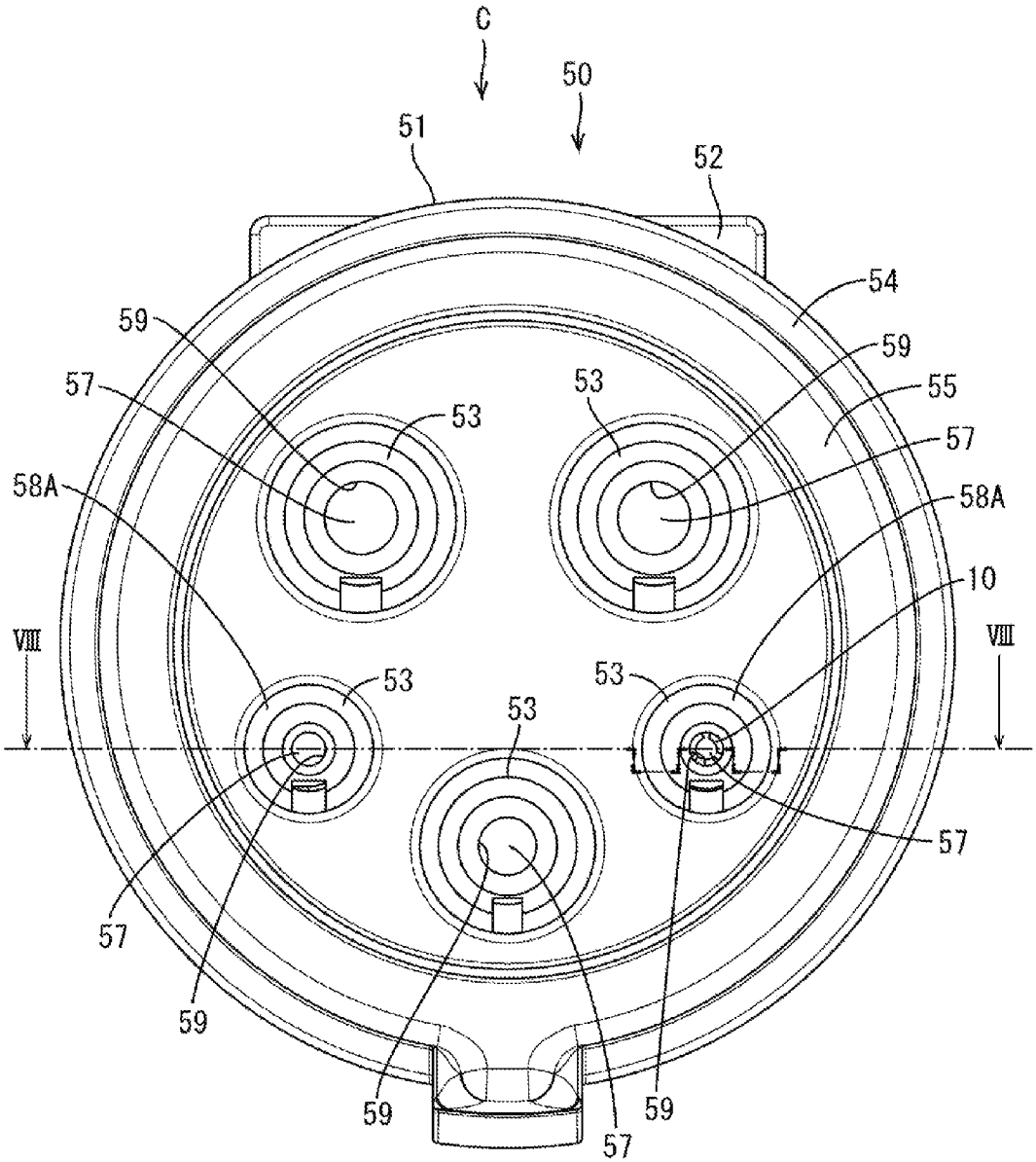
FIG. 7 is a front view of a connector.

The housing 50 is made of synthetic resin and includes, as shown in FIGS. 7 and 8, a housing main body 51 with a short cylindrical base 52 and five tubular portions 53 projecting in a predetermined arrangement from a front surface of the base 52.

A flange 54 is formed on the outer periphery of the front end of the base 52 of the housing main body 51. A tubular receptacle 55 having an open front surface is formed at a predetermined distance from the outer periphery of a group of the tubular portions 53 on the front surface of the flange 54. An opening edge of the receptacle 55 projects more forward than the front ends of the tubular portions 53 by a predetermined distance as shown in FIG. 8.

The receptacle 55 of the housing 50 is inserted tightly into an insertion port open on a panel of the vehicle (not shown). The insertion is stopped by the contact of the flange 54 with an opening edge of the insertion port on a front surface and, associated with that, the receptacle 55 and front ends of the tubular portions 53 of the housing main body 51 are connected to the mating vehicle-side connector arranged on the back side of the insertion port.

On the other hand, the base 52 of the housing main body 51 is fit and mounted on the tip of the gun-shaped case.

Five terminal accommodating chambers 57 are formed in the housing main body 51 in an arrangement as shown in FIG. 7. The terminal accommodating chambers 57 extend in the front-back direction from the rear surface of the base 52 to reach the respective tubular portions 53 through the inside of the base 52. The two terminal accommodating chambers 57 in an upper stage of FIG. 7 are for the power terminals, the slightly lower one in a center out is for the ground terminal and left and right lower ones are for the signal terminals.

Basic structures of the respective terminal accommodating chambers 57 are similar although diameters and the like may be different in accordance with the types of the terminal fittings 10 to be accommodated. The following description is given, taking the terminal accommodating chamber 57 for the signal terminal as an example.

As shown in FIG. 8, the terminal accommodating chamber 57 has a stepped shape so that a front half located in the tubular portion 53 has a small diameter and a rear half penetrating through the inside of the base 52 has a large diameter. More specifically, the front half having the small diameter serves as a front accommodating portion 58A in which the terminal connecting portion 11 of the terminal fitting 10 is to be accommodated, and the inner peripheral surface of the front end thereof is contracted in diameter to form a terminal insertion opening 59 into which the mating vehicle-side terminal is to be inserted.

The rear half has the large diameter and accommodates a rear accommodating portion 58B into which a sleeve 20 arranged around the crimped wire connecting portion 17 of the terminal fitting 10 on a rear part of the terminal fitting 10.

The sleeve 20 is made of synthetic resin and functions to prevent the terminal fitting 10 from coming out backward from the terminal accommodating chamber 57. The sleeve 20 is formed into a substantially hollow cylindrical shape substantially tightly fittable to the rear accommodating portion 58B and is provided internally with an accommodation space 21 capable of accommodating the wire connecting portion 17 and parts before and after the wire connecting portion 17. More specifically, the sleeve 20 includes a sleeve main body 22 that is slightly shorter than the rear accommodating portion 58B and has a cylindrical outer shape. The sleeve main body 22 is formed with a through hole 23 penetrating through upper and lower surfaces, and the inside of this through hole 23 defines the accommodation space 21.

Figure 1:
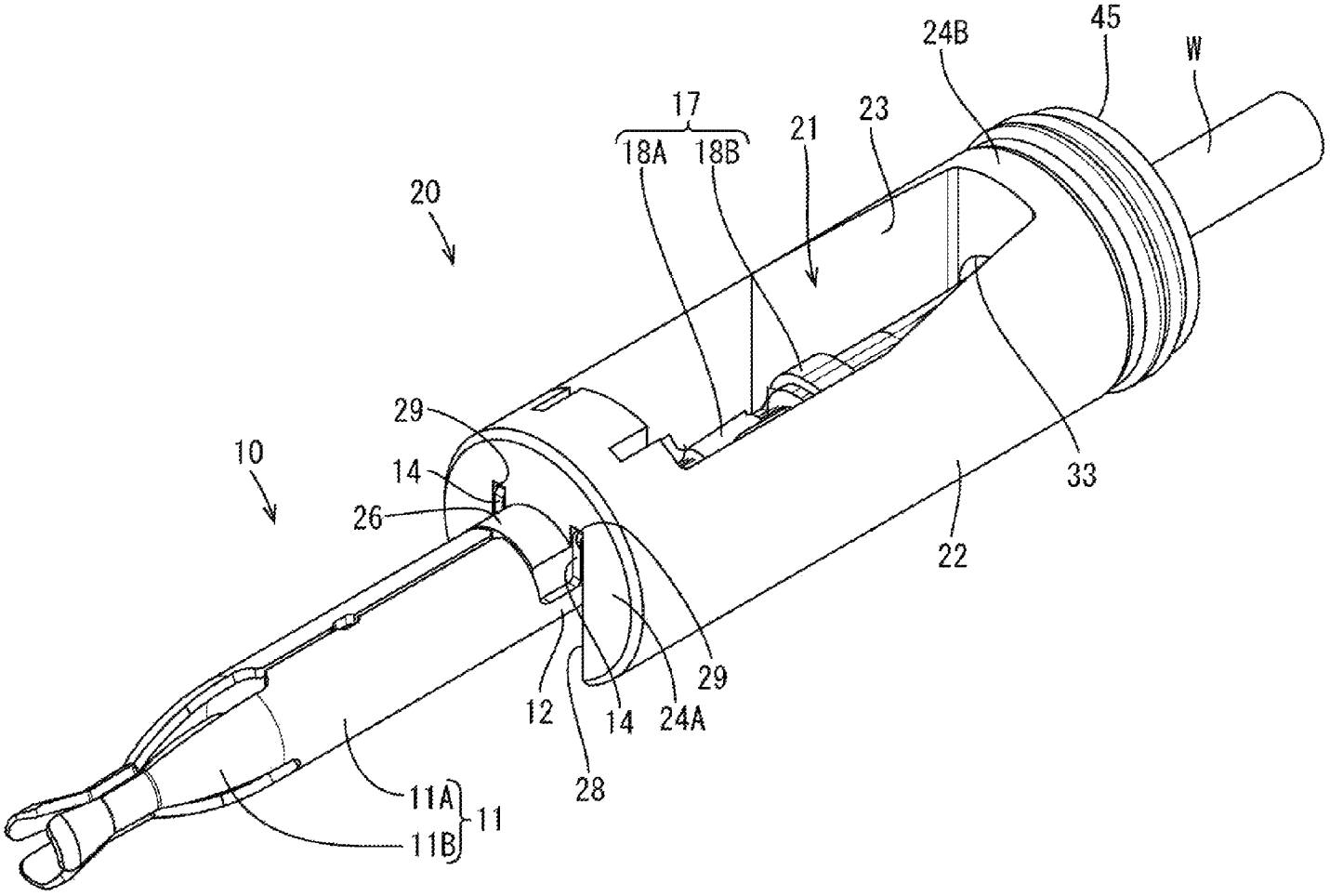
FIG. 1 is a perspective view of a state where a terminal fitting, a sleeve and a rubber plug are mounted on an end of a wire according to an embodiment.
Figure 2:
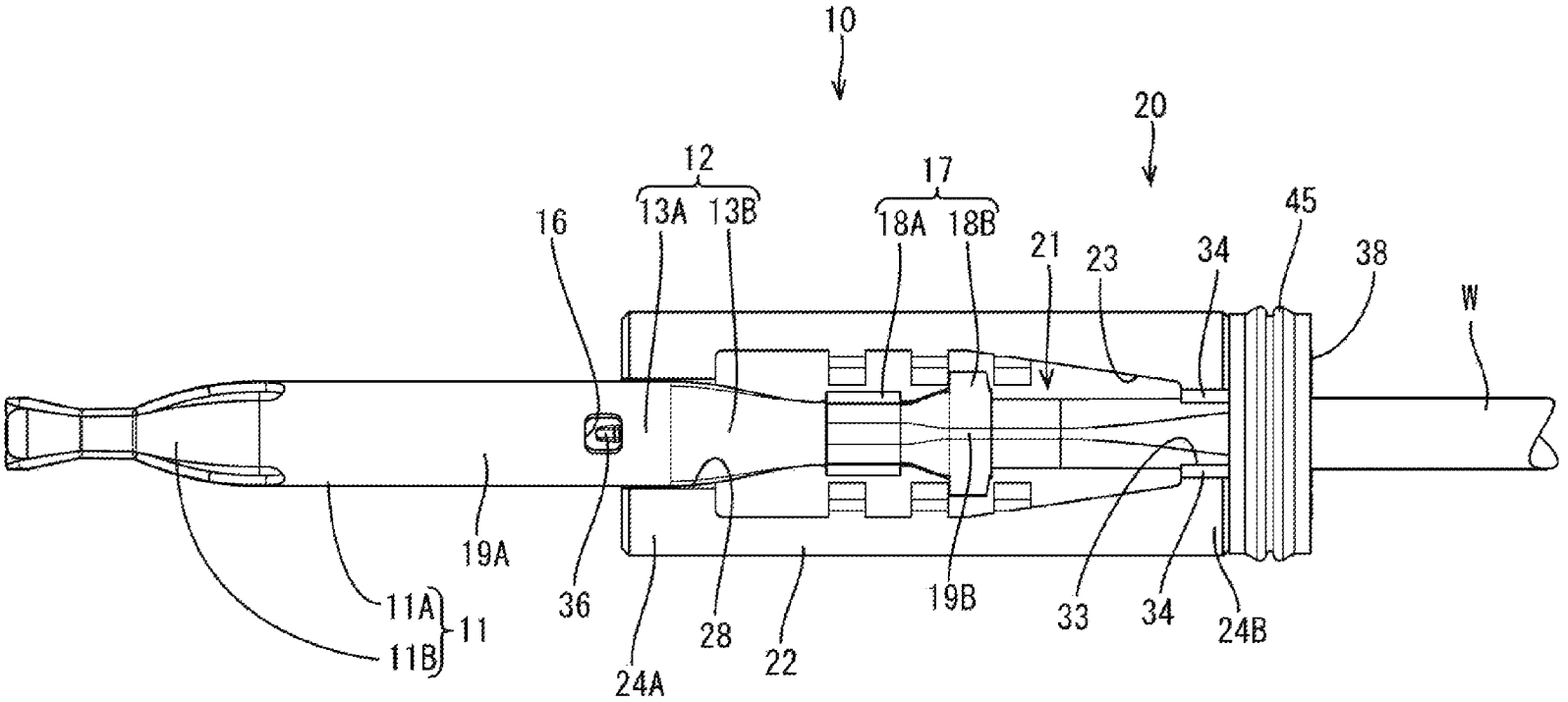
FIG. 2 is a bottom view of the state of FIG. 1.
Figure 3:
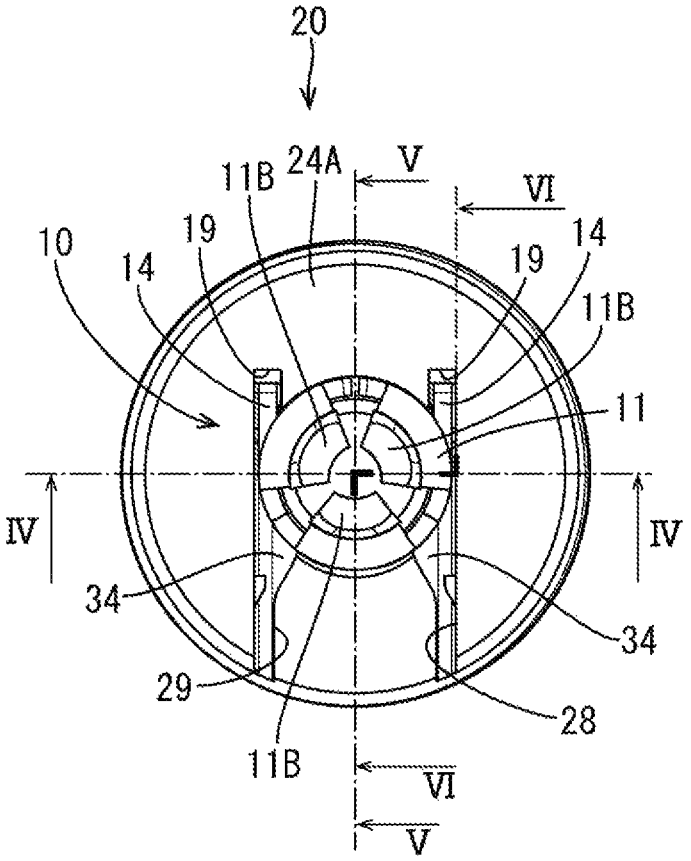
FIG. 3 is a front view of the state of FIG. 1.

As shown in FIG. 1, the through hole 23 has a length that is about ¾ of the entire length of the sleeve main body 22, and a width that is slightly more than 80% of a diameter of the sleeve main body 22, and is formed at a position of the sleeve main body 22 slightly displaced to the rear. Thus, a front wall 24A of the accommodation space 21 is relatively thick and a rear wall 24B is thin.

As shown in FIG. 8, a fitting protrusion 25 in the form of a round bar projects forward in a center of the front surface of the front wall 24A and is substantially tightly fittable into a rear end in the main body portion 11A of the terminal connecting portion 11 of the terminal fitting 10. As shown in FIG. 1, an arcuate stopper 26 is formed on the upper surface of a base end side of the fitting protrusion 25 and is capable of abutting against the upper edge of the rear end surface of the terminal connecting portion 11.

As shown in FIG. 1, a front insertion groove 28 is formed on the lower surface of the front wall 24A of the sleeve main body 22 and the equal-width portion 13A in the coupling 12 of the terminal fitting 10 is insertable through the front insertion groove 28 from below. The front surface of this front insertion groove 28 is open and the rear surface communicates with the front surface of the through hole 23. An arcuate portion 28A is formed on the ceiling surface of the front insertion groove 28 so as to be flush with the lower surface of the fitting protrusion 25 and the groove bottom of the equal-width portion 13A of the coupling 12 contacts the arcuate portion 28A.

Figure 6:
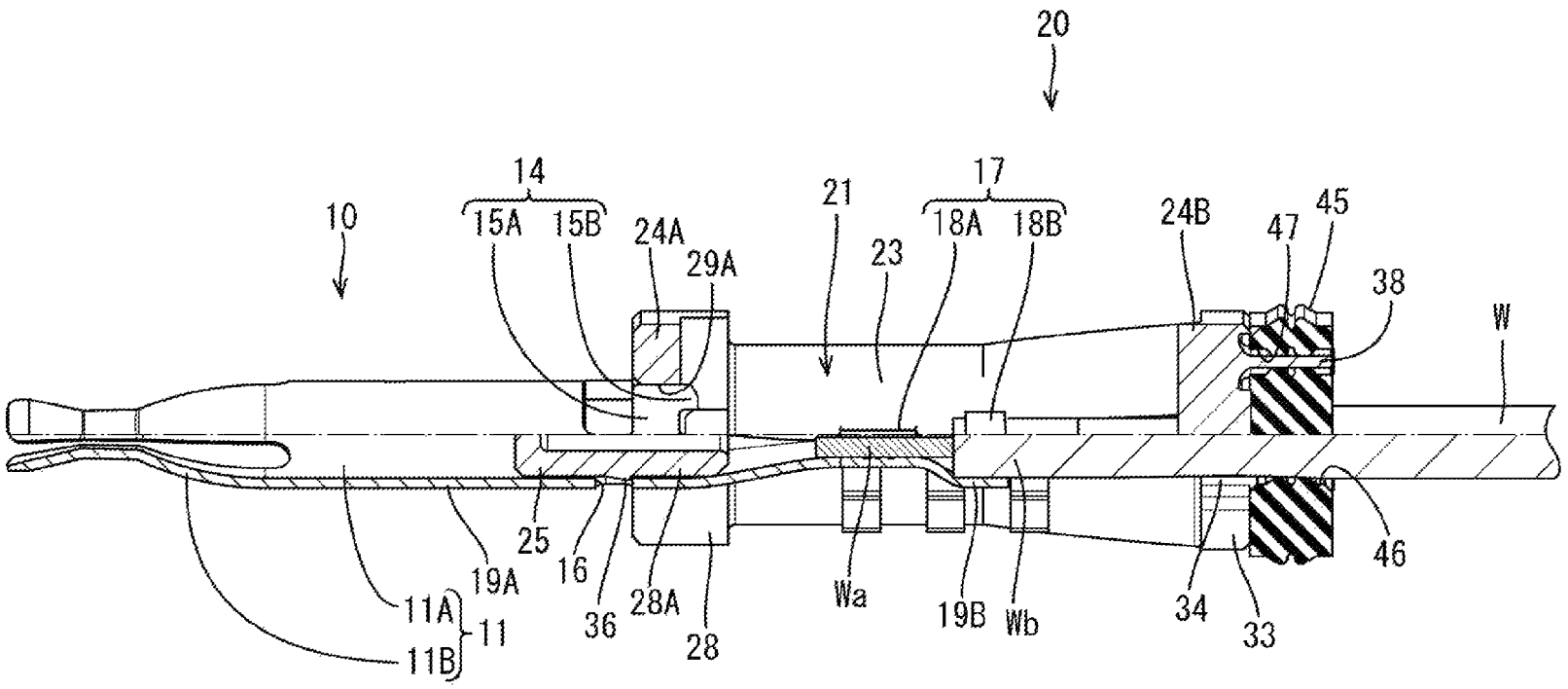
FIG. 6 is a section along VI-VI of FIG. 3.

Two slits 29 are on opposite left and right side surfaces of the front insertion groove 28 and receive the inclination regulating pieces 14 that stand on the opposite left and right walls of the equal-width portion 13A of the terminal fitting 10. As shown in FIG. 6, a ceiling surface 29A of each slit 29 is set at such a position that the upper surface of the sandwiched portion 15B of the inclination regulating piece 14 comes into contact with the ceiling surface 29A when the equal-width portion 13A of the coupling 12 of the terminal fitting 10 is inserted into the front insertion groove 28 from below and reaches a proper position where the groove bottom of the equal-width portion 13A is in contact with the arcuate portion 28A.

Further, as shown in FIG. 6, sandwiching protrusions 30 which can come to lower surface sides of projecting end parts of the sandwiched portions 15B of the inclination regulating pieces 14 from behind when the equal-width portion 13A of the coupling portion 12 of the terminal fitting 10 is inserted to the proper position into the front insertion groove 28 as described above are formed to protrude at positions of the left and right side surfaces of the front insertion groove 28 along a rear edge part. Specifically, as described later, the sandwiched portions 15B of the inclination regulating pieces 14 are sandwiched by the ceiling surfaces 29A of the slits 29 and the sandwiching protrusions 30, thereby regulating such inclination of the terminal fitting 10 relative to the sleeve 20 as to incline axial lines of the terminal fitting 10 and the sleeve 20 relative to each other.

As shown in FIG. 5, a rear insertion groove 33 through which the wire W pulled out from the terminal fitting 10 is radially insertable from below is formed on the lower surface of the rear wall 24B of the sleeve main body 22. The rear surface of this rear insertion groove 33 is open and the front surface communicates with the rear surface of the through hole 23. Locking protrusions 34 for locking the wire W radially inserted through the rear insertion groove 33 and holding this wire W on the same axial line as the terminal fitting 10 are formed to face each other on left and right side surfaces of the rear insertion groove 33.

As described above, the front and rear insertion grooves 28, 33 are formed before and after the through hole 23 to communicate, whereby an insertion groove through which the coupling portion 12 and the wire connecting portion 17 of the terminal fitting 10 and the wire W pulled out from the wire connecting portion 17 are radially insertable is formed over the entire length on the lower surface of the sleeve main body 22 as shown in FIG. 5.

Although described in detail later, the sleeve 20 is arranged on the rear part of and concentrically with the terminal fitting 10 such that the fitting protrusion 25 projecting on the front surface of the sleeve main body 22 is fitted into the rear end of the main body portion 11A of the terminal connecting portion 11. As a means for coupling and locking the sleeve 20 on the rear part of the terminal fitting 10, a lock protrusion 36 is formed on the lower surface of the base end side of the fitting protrusion 25 of the sleeve 20 as shown in FIG. 5, whereas a lock hole 16 is open at a position of the bottom surface of the equal-width portion 13A of the coupling portion 12 near the front end. By fitting the lock protrusion 36 into the lock hole 16 when the fitting protrusion 25 is fitted into the rear end of the main body portion 11A by a regular amount, the terminal fitting 10 and sleeve 20 are locked in an integrally coupled state.

Figure 11:
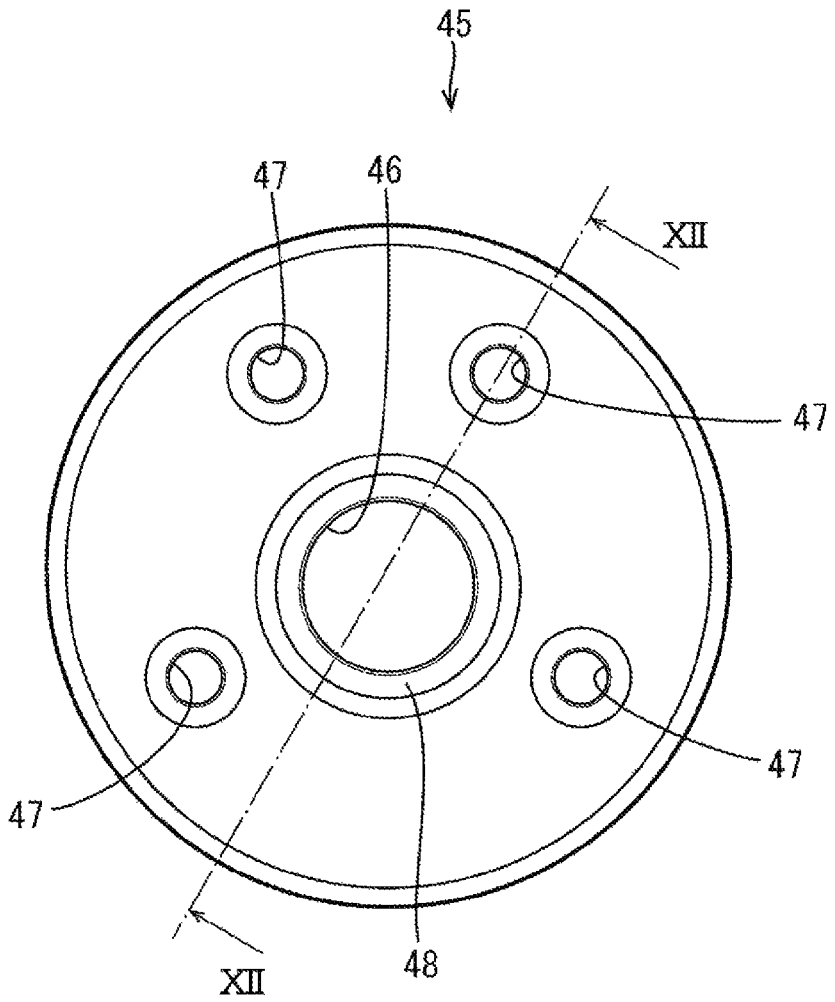
FIG. 11 is a front view of the rubber plug
Figure 12:
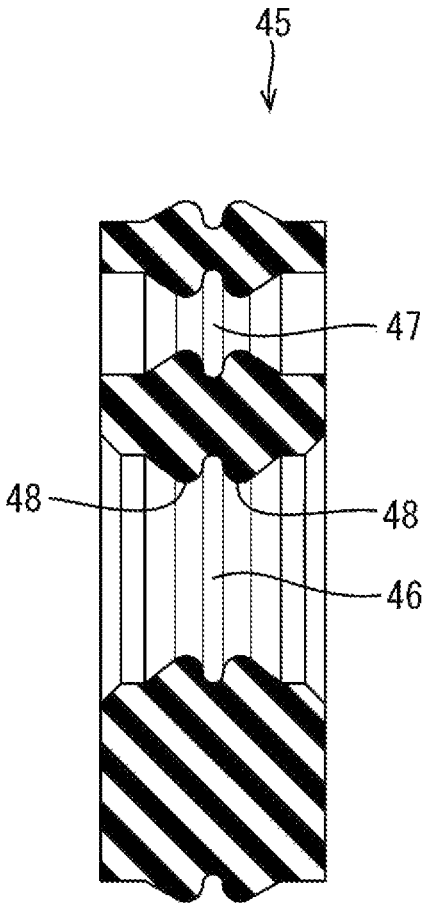
FIG. 12 is a section along XII-XII of FIG. 11.

A rubber plug 45 is mounted on the rear end surface of the sleeve main body 22. As shown in FIGS. 11 and 12, the rubber plug 45 is formed into a thick ring shape closely fittable to the rear end part of the rear accommodating portion 58 of the terminal accommodating chamber 57, and the wire W is closely insertable into a center hole 46. As described above, the sleeve 20 functions to retain the terminal fitting 10 and, for that purpose, a plurality of (four in the shown example) rods 38 shown in FIG. 6 are formed to project backward on the rear surface of the sleeve main body 22. The rods 38 have a length slightly larger than a thickness of the rubber plug 45. On the other hand, the rubber plug 45 is formed with as many insertion holes 47 as the respective rods 38 in a corresponding arrangement, the rods 38 being tightly inserted into the insertion holes 47.

As shown in FIG. 8, a length of the sleeve 20 from the front surface of the sleeve main body 22 to projecting ends of the rods 38 is set to be equal to a length of the rear accommodating portion 58B.

A rear holder 60 for retaining the sleeves 20 is mountable on the rear surface of the base portion 52 of the housing main body 51 as shown in FIG. 8. The rear holder 60 is made of synthetic resin and includes a circular holder base plate 61 capable of coming into contact with the rear end of the base portion 52 from behind. By mounting and fixing the rear holder 60 to the housing 50 in a state where the holder base plate 61 is held in contact with the projecting ends of the rods 38 projecting from the rear surface of the sleeve 20 and penetrating through the rubber plugs 45 from behind, the sleeve 20 is prevented from coming out backward. In this way, a backward movement of the terminal fitting 10 is obstructed via the sleeve 20 by the rear holder 60.

As partly already described, a part of the end of the wire W connected to the wire connecting portion 17 of the terminal fitting 10 by crimping is sealed, utilizing the heat shrinkable tube T. The heat shrinkable tube T is fitted on the outer periphery of the wire connecting portion 17 while being accommodated in the accommodation space 21 of the sleeve 20 arranged on the rear part of the terminal fitting 10 and, thereafter, held in close contact with the outer peripheries of the wire connecting portion 17 and the like by thermal shrinkage.

Figure 4:
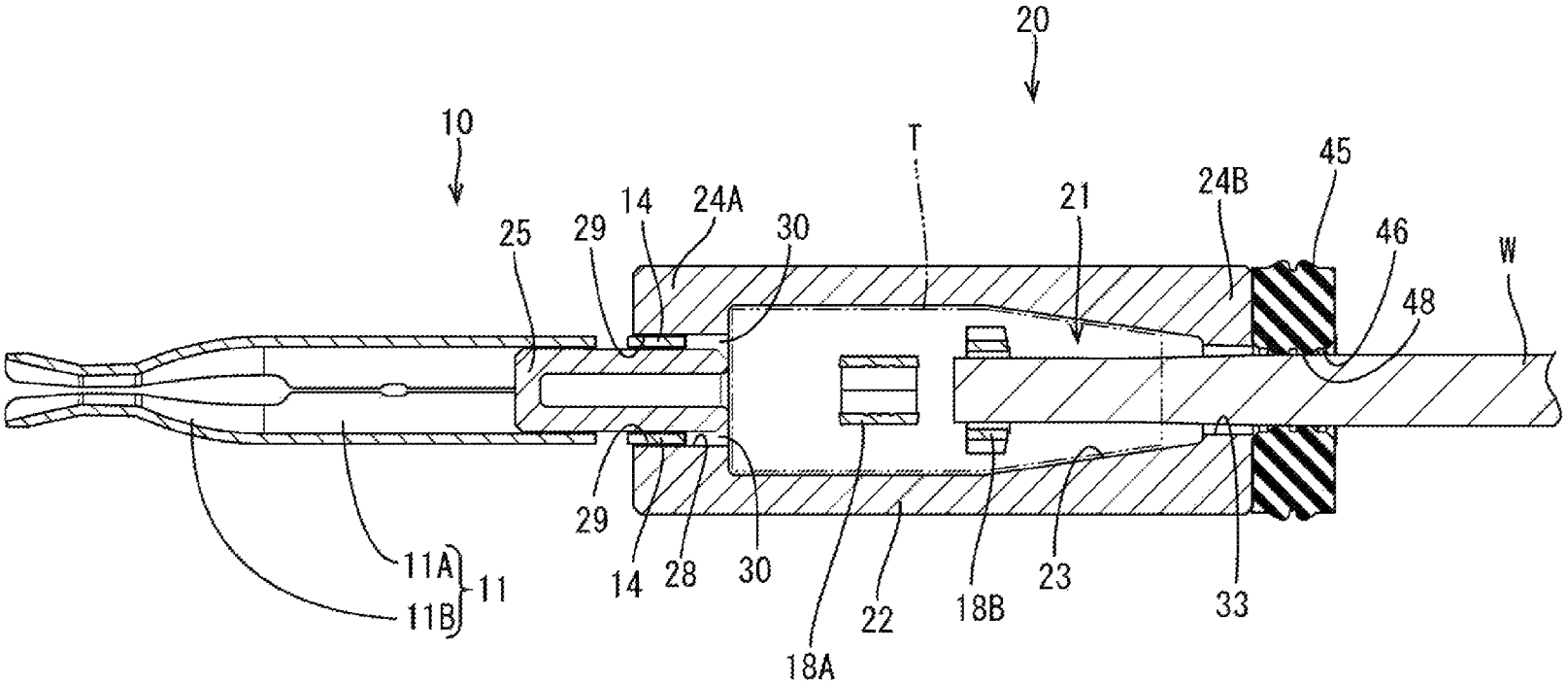
FIG. 4 is a section along IV-IV of FIG. 3

The heat shrinkable tube T is made of synthetic resin having a lower melting point than the sleeve 20 and, as shown in FIGS. 4 and 5, has a diameter comparable to a width of the accommodation space 21 formed in the sleeve 20 and a length slightly shorter than the accommodation space 21 and is formed into a hollow cylindrical shape to have appropriate rigidity. Adhesive is applied to the inner peripheral surface of the heat shrinkable tube T.

As shown in FIG. 5, a center position P2 of the center hole 46 of the rubber plug 45 of this embodiment is displaced downwardly (toward the rear bottom plate 19B) from a center position P1 of the terminal connecting portion 11. Further, a height of the front bottom plate 19A of the terminal connecting portion 11 and that of the rear bottom plate 19B of the insulation barrels 18B are aligned with the wire connecting portion 17 crimped to the wire W. Thus, the wire W moves to a position lower than the center position P1 of the terminal connecting portion 11 by being connected to the wire connecting portion 17. Accordingly, by displacing the center position P2 of the center hole 46 of the rubber plug 45 downwardly, a center position of the wire W pulled out backward from the insulation barrels 18B and the center position P2 of the center hole 46 of the rubber plug 45 substantially coincide. By doing so, inner peripheral lips (corresponding to a sealing surface of a wire sealing hole) of the center hole 46 of the rubber plug 45 are substantially evenly squeezed by the wire W.

Particularly, since the amount of squeezing of the inner peripheral lips 48 is originally small in the case of a thin wire W, sealing performance may be reduced because the inner peripheral lips 48 cannot be sufficiently squeezed in some places if the center position of the wire W is displaced from the center position P2 of the center hole 46. However, by adopting the above configuration, it is possible to ensure sealing performance and deal with the thin wire W. On the other hand, if a thick wire W is used instead of the thin wire W, the amount of displacement from the center position P2 of the center hole 46 is larger than in the case of the thin wire W. However, the amount of squeezing of the inner peripheral lips 48 is originally large in the case of the thick wire W and, even if the center position of the wire W is slightly displaced, the amount of squeezing sufficient to exhibit sealing performance can be ensured and a situation where sealing performance is reduced is unlikely to occur, wherefore there is no problem.

Next, functions of this embodiment are described.

The connector C is assembled, for example, in the following procedure. First, the terminal fitting 10 is connected to the end of the wire W. Specifically, the rubber plug 45 is first mounted on the end of the wire W and allowed to escape backward. In this state, the end processing such as stripping is applied to the end of the wire W, the wire barrels 18A are caulked and crimped to the end of the core Wa exposed on the wire W and the insulation barrels 18B are caulked and crimped to the end of the insulation coating Wb.

Thereafter, the heat shrinkable tube T is fitted from front of the terminal fitting 10 and pushed to a position to surround the caulked wire connecting portion 17 (wire barrels 18A and insulation barrels 18B). At this time, the heat shrinkable tube T is received by the upper surface of the wire connecting portion 17 and the like and in a hanging-down state.

Subsequently, the sleeve 20 is coupled and mounted on the rear part of the terminal fitting 10. The sleeve 20 is arranged above the wire connecting portion 17 of the terminal fitting 10 while assuming an oblique posture inclined downwardly toward the front and, after the tip of the fitting protrusion 25 is inserted into the opening on the rear surface of the terminal connecting portion 11 of the terminal fitting 10, the sleeve 20 is pushed forward while the rear end side is pushed down to change the orientation into a horizontal posture.

As the sleeve 20 is pushed down, the coupling portion 12 and the wire connecting portion 17 of the terminal fitting 10, the wire W pulled out from the wire connecting portion 17 and the fitted heat shrinkable tube T are mounted into the sleeve main body 22. On the other hand, as the sleeve 20 is pushed forward, the fitting protrusion 25 is inserted into the rear end part of the main body portion 11A of terminal connecting portion 11 and the left and right inclination regulating pieces 14 of the terminal fitting 10 are inserted into the left and right slits 29 from front.

When the sleeve 20 is pushed down into the horizontal posture, the wire W pulled out from the wire connecting portion 17 is pushed until coming into contact with the ceiling surface of the rear insertion groove 33 and locked by the left and right locking protrusions 34 to be prevented from coming out downward. Simultaneously with that, the sandwiched portions 15B of the left and right inclination regulating pieces 14 are held in contact with the ceiling surfaces 29A of the slits 29.

On the other hand, the forward pushing of the sleeve 20 is stopped by the contact with the stopper portion 26 provided on the upper surface of the base end of the fitting protrusion 25 with the upper edge of the rear end surface of the terminal connecting portion 11. At this time, as shown in FIG. 6, the sandwiching protrusions 30 formed to protrude on the left and right side surfaces of the front insertion groove 28 come to the lower surface sides of the projecting end parts of the sandwiched portions 15B of the inclination regulating pieces 14, with the result that the sandwiched portions 15B of the left and right inclination regulating pieces 14 are sandwiched by the ceiling surfaces 29A of the slits 29 and the sandwiching protrusions 30, whereby the terminal fitting 10 and the sleeve 20 are concentrically coupled while being regulated not to incline such that the axial lines thereof are inclined relative to each other. In addition, the lock protrusion 36 of the fitting protrusion 25 of the sleeve 20 is fitted into the lock hole 16 of the coupling portion 12, whereby the terminal fitting 10 and the sleeve 20 are locked in a concentrically and integrally coupled state while the inclination thereof is regulated as described above.

In a state where the sleeve 20 is assembled with the terminal fitting 10 by being pushed upward and forward, the assembly is set in an unillustrated heating apparatus to perform a heating operation of heating the heat shrinkable tube T through the through hole 23 of the sleeve 20. Here, since the terminal fitting 10 and the sleeve 20 are integrally coupled not to incline relative to each other and locked, the assembly is easily handled such as when being set in the heating apparatus.

When being heated, the heat shrinkable tube T is gradually contracted in diameter while the adhesive applied to the inner peripheral surface is melted. Since the upper part of the inner peripheral surface of the heat shrinkable tube T is not placed on the wire connecting portion 17, the clearance is secured and a space on the lower side of the inner peripheral surface of the heat shrinkable tube T is eliminated, the flow-down of the adhesive on the upper side of the inner peripheral surface is suppressed. Particularly, it is significant to ensure the amount of the adhesive on the upper side of the inner peripheral surface of the heat shrinkable tube T held in close contact with the uneven upper surface of the wire connecting portion 17.

Thus, when the heat shrinkable tube T is contracted in diameter until coming into close contact with the outer peripheral surface of the wire connecting portion 17, the heat shrinkable tube T is bonded with the amount of the adhesive ensured over the entire circumference including the uneven upper surface, with the result that sealing is reliably provided around the wire connecting portion 17, i.e. the end of the wire W over the entire circumference.

Further, since being positioned and fitted over the wire connecting portion 17 and the predetermined areas before and after the wire connecting portion 17, the heat shrinkable tube T is reliably held in close contact with the wire connecting portion 17 over the entire length including front and rear areas and sealability is ensured.

After a sealing operation by thermally shrinking the heat shrinkable tube T is completed, the rubber plug 45 is mounted on the rear surface of the sleeve main body 22. The rubber plug 45 mounted first and allowed to escape is slid forward along the wire W and pushed and mounted until coming into contact with the rear surface of the sleeve main body 22 while the respective rods 38 are inserted into the corresponding insertion holes 47.

By the above, the terminal fitting 10, the sleeve 20 and the rubber plug 45 are mounted on the end of the wire W.

The terminal fitting 10, the sleeve 20 and the rubber plug 45 mounted on the end of the wire W as described above are inserted into the corresponding terminal accommodating chamber 57 formed in the housing main body 51 from behind. The insertion is stopped when the front surface of the sleeve main body 22 comes into contact with the front surface (stepped surface) of the rear accommodating portion 58B as shown in FIG. 8, the terminal connecting portion 11 of the terminal fitting 10 is inserted substantially over the entire length into the front accommodating portion 58A and the rubber plug 45 mounted on the rear surface of the sleeve main body 22 is tightly fitted into the rear end part of the rear accommodating portion 58B.

After the predetermined terminal fittings 10 are inserted into all the terminal accommodating chambers 57, the wires W are pulled out backward from the rear surface of the base portion 52 of the housing main body 51. When the rear holder 60 is slid forward along the wires W and fitted and locked to the rear surface of the base portion 52, the holder base plate 61 comes into contact with the tips of the rods 38 projecting from the rear surfaces of the sleeve main bodies 22 and penetrating through the rubber plugs 45 to retain the sleeves 20.

In this way, if a backward tensile force acts on the wire W, the standing portions 15A of the respective inclination regulating pieces 14 come into contact with the respective sandwiching protrusions 30 to obstruct a backward movement of the terminal fitting 10. Alternatively, the rear end of the terminal connecting portion 11 of the terminal fitting 10 comes into contact with the stopper portion 26 of the sleeve 20 retained by the rear holder 60 to obstruct a backward movement of the terminal fitting 10, with the result that each terminal fitting 10 is retained and accommodated in the corresponding terminal accommodating chamber 57 (front accommodating portion 58A).

In the above manner, the assembling of the connector C is completed, the thus assembled connector C is mounted on the tip part of the gun-shaped case and the wires W pulled out backward from the connector C are pulled out from the rear end of the gun-shaped case and connected to an external power supply after being bundled.

During a charging operation, the connector C provided on the tip of the gun-shaped case is connected to the mating vehicle-side connector through the insertion port open on the panel of the vehicle.

As described above, the connector C disclosed by this embodiment is provided with the terminal fittings 10 each including the terminal connecting portion 11 to be connected to the mating terminal, the rear bottom plate 19B extending backward from the terminal connecting portion 11 and a pair of barrels to be crimped to the wire W by being pushed toward the rear bottom plate 19B across the wire W arranged between the rear bottom plate 19B and the pair of barrels standing up from the rear bottom plate 19B, the housing 50 including the terminal accommodating chambers 57 configured to accommodate the terminal fittings 10, the sleeves 20 each including the accommodation space 21 configured to accommodate the pair of barrels crimped to the wire W, the rear insertion groove 33 provided in the rear wall 24B of the accommodation space 21 such that the wire W extending backward from the pair of barrels penetrates therethrough, and the plurality of rods 38 projecting backward from the rear wall 24B of the accommodation space 21, the rubber plugs 45 each including the plurality of insertion holes 47 configured such that the plurality of rods 38 are press-fit thereinto to mount the rubber plug 45 on the rear wall 24B of the accommodation space 21 from behind and the center hole 46 configured such that the wire W extending backward from the rear wall 24B of the accommodation space 21 penetrates therethrough in a sealed state, and the rear holder 60 configured to obstruct a backward movement of the terminal fittings 10 via the sleeves 20 by being mounted on the housing 50 while being held in contact with the rods 38 from behind. The center position P2 of the center hole 46 is displaced toward the rear bottom plate 19B from the center position P1 of the terminal connecting portion 11.

According to this configuration, the center position of the wire W is more displaced toward the rear bottom plate 19B from the center position P1 of the terminal connecting portion 11 by crimping the pair of barrels to the wire W particularly in the case of a thin wire W than in the case of a thick wire W. However, since the center position P2 of the center hole 46 is displaced toward the rear bottom plate 19B from the center position P1 of the terminal connecting portion 11, the wire W can be directly pulled out backward. Thus, the amount of squeezing of the inner peripheral sealing surface of the center hole 46 can be made substantially equal over the entire circumference and a reduction of sealing performance can be avoided.

On the other hand, in the case of a thick wire W, the center position of the wire W is displaced upward (toward a side opposite to the rear bottom plate 19B) from the center position P2 of the center hole 46 by crimping the pair of barrels to the wire W. However, the amount of squeezing of the inner peripheral sealing surface of the center hole 46 is originally larger than in the case of a thin wire W and the inner peripheral sealing surface of the center hole 46 can be held in close contact with the outer peripheral surface of the wire W over the entire circumference. Thus, sealing performance is not reduced. As just described, sealing performance can be ensured for both thin wires W and thick wires W and a range of applicable wires can be expanded.

The terminal connecting portion 11 may include the hollow cylindrical main body portion 11A extending in the front-back direction, the inclination regulating pieces 14 may be arranged behind the main body portion 11A on the terminal fitting 10 and the sleeve 20 may include the fitting protrusion 25 configured to support the main body portion 11A by being fitted into the main body portion 11A and the sandwiching protrusions 30 configured to obstruct a backward movement of the terminal fitting 10 by being locked to the inclination regulating pieces 14 from behind when the fitting protrusion 25 is fitted into the main body portion 11A.

According to this configuration, a backward movement of the terminal fitting 10 can be obstructed by fitting the fitting protrusion 25 into the main body portion 11A to support the main body portion 11A and locking the sandwiching protrusions 30 to the inclination regulating pieces 14 from behind.

The wire W may be so configured that the core Wa is covered by the insulation coating Wb, and the barrel may include the wire barrel 18A to be crimped to the core Wa and the insulation barrel 18B to be crimped to the insulation coating Wb.

According to this configuration, a holding force for the wire W can be ensured by the wire barrels 18A and the center position of the wire W can be appropriately set by the insulation barrels 18B.

The technology disclosed by this specification is not limited to the above described and illustrated embodiment. For example, the following various modes are also included.

Although the center hole 46 located in the center of the rubber plug 45 serves as a wire sealing hole in the above embodiment, the wire sealing hole may be located at a position displaced from the center of the rubber plug 45.

Although the inclination regulating pieces 14 serve as a locking portion in the above embodiment, a backward movement of the terminal fitting 10 may be obstructed by tapering the fitting protrusion 25 toward the tip.

Although the barrel includes both the wire barrel 18A and the insulation barrel 18B in the above embodiment, the insulation barrel may be omitted.

LIST OF REFERENCE SIGNS

10 . . . terminal fitting (terminal)
11 . . . terminal connecting portion
11A . . . main body portion
14 . . . inclination regulating piece (locking portion)
18A . . . wire barrel (barrel)
18B . . . insulation barrel (barrel)
19B . . . rear bottom plate (bottom plate)
20 . . . sleeve
21 . . . accommodation space
24B . . . rear wall
25 . . . fitting protrusion
30 . . . sandwiching protrusion (locked portion)
33 . . . rear insertion groove (insertion groove)
38 . . . rod (press-fit projection)
45 . . . rubber plug
46 . . . center hole (wire sealing hole)
47 . . . insertion hole (press-fit hole)
50 . . . housing
57 . . . terminal accommodating chamber
60 . . . holder
P1 . . . center position of terminal connecting portion
P2 . . . center position of center hole (center position of wire sealing hole)
W . . . wire
Wa . . . core
Wb . . . insulation coating

What is claimed is:

1. A connector, comprising:

a terminal including a terminal connecting portion to be connected to a mating terminal, a bottom plate extending back from the terminal connecting portion and a pair of barrels to be crimped to a wire by being pushed toward the bottom plate across the wire arranged between the bottom plate and the pair of barrels standing up from the bottom plate;

a housing including a terminal accommodating chamber configured to accommodate the terminal;

a sleeve including an accommodation space configured to accommodate the pair of barrels crimped to the wire, an insertion groove provided in a rear wall of the accommodation space such that the wire extending back from the pair of barrels penetrates therethrough, and a plurality of press-fit projections projecting back from the rear wall of the accommodation space;

a rubber plug including a plurality of press-fit holes configured such that the plurality of press-fit projections are press-fit therein to mount the rubber plug on the rear wall of the accommodation space and a wire sealing hole configured such that the wire (W) extending back from the rear wall of the accommodation space penetrates therethrough in a sealed state; and a holder configured to obstruct a backward movement of the terminal via the sleeve by being mounted on the housing while being held in contact with the press-fit projections from behind, a center position of the wire sealing hole being displaced toward the bottom plate from a center position of the terminal connecting portion.

2. The connector of claim 1, wherein the terminal connecting portion includes a hollow cylindrical main body portion extending in a front-back direction, a locking portion is arranged behind the main body portion on the terminal, and the sleeve includes a fitting protrusion configured to support the main body portion by being fitted into the main body portion and a locked portion configured to obstruct a backward movement of the terminal by being locked to the locking portion from behind when the fitting protrusion is fitted into the main body portion.

3. The connector of claim 1, wherein the wire is configured such that a core is covered by an insulation coating, and the barrel includes a wire barrel to be crimped to the core and an insulation barrel to be crimped to the insulation coating.

* * * * *